US011910877B2

(12) United States Patent
Dharia

(10) Patent No.: US 11,910,877 B2
(45) Date of Patent: Feb. 27, 2024

(54) CUSTOMIZABLE PRESSURE RELIEVING DEVICE

(71) Applicant: Amitkumar Dharia, Coppell, TX (US)

(72) Inventor: Amitkumar Dharia, Coppell, TX (US)

( * ) Notice: Subject to any disclaimer, the term of this patent is extended or adjusted under 35 U.S.C. 154(b) by 0 days.

(21) Appl. No.: 17/333,991

(22) Filed: May 28, 2021

(65) Prior Publication Data

US 2022/0031013 A1 Feb. 3, 2022

Related U.S. Application Data

(60) Provisional application No. 63/134,708, filed on Jan. 7, 2021, provisional application No. 63/058,699, filed on Jul. 30, 2020.

(51) Int. Cl.

| | |
|---|---|
| ***A43B 7/148*** | (2022.01) |
| ***A43B 13/18*** | (2006.01) |
| ***A43B 3/00*** | (2022.01) |
| ***A43B 7/1455*** | (2022.01) |
| ***A43B 7/1464*** | (2022.01) |

(52) U.S. Cl.

CPC ..... *A43B 7/148* (2013.01); *A43B 3/0031* (2013.01); *A43B 7/146* (2013.01); *A43B 7/1464* (2022.01); *A43B 13/187* (2013.01)

(58) Field of Classification Search

CPC ..... A43B 17/003; A43B 7/146; A43B 7/148; A43B 3/0031; A43B 13/187

See application file for complete search history.

(56) References Cited

U.S. PATENT DOCUMENTS

| | | | | |
|---|---|---|---|---|
| 1,637,565 | A * | 8/1927 | Gordon | A63B 21/065 36/132 |
| 4,249,319 | A * | 2/1981 | Yoshida | A61F 7/03 36/2.6 |
| 5,438,768 | A * | 8/1995 | Bauerfeind | A43B 7/1445 36/43 |
| 5,768,803 | A | 6/1998 | Levy | |
| 6,000,147 | A * | 12/1999 | Kellerman | A43B 17/02 36/44 |
| 6,243,974 | B1 * | 6/2001 | Schaj | A43B 3/108 36/11.5 |
| 10,188,172 | B1 | 1/2019 | Wurtz | |

(Continued)

OTHER PUBLICATIONS

Magnetic massage insoles, https://www.dhgate.com/product/magnetic-massage-foot-therapy-reflexology/456877316.html.

*Primary Examiner* — Katharine G Kane

(57) ABSTRACT

The pressure relieving device is intended to provide users with a stress relieving support surface that is customizable. To that end, the device includes a sleeve with one or more compartments that may be individually filled and refilled with a deformable media. The deformable media further includes a mixture of both non-rigid deformable and rigid non-deformable particles that enable the device to conform to any shape when acted upon by a pressure and recover back when pressure is removed. The device may act as a footwear component for use as a shoe insole insert which may be customized by the user to relieve pain in the areas of foot where most required. Accordingly, the footwear component adapts to the user's foot pattern while standing or moving. Furthermore, the device is durable, washable and reusable, and may be used with open shoes, closed shoes or even without any shoes.

18 Claims, 7 Drawing Sheets

(56) References Cited

U.S. PATENT DOCUMENTS

| | | | | |
|---|---|---|---|---|
| 2003/0009909 | A1* | 1/2003 | Chen | A43B 13/14 36/141 |
| 2004/0194344 | A1 | 10/2004 | Tadin | |
| 2005/0210704 | A1* | 9/2005 | Connolly | A43B 7/02 36/2.6 |
| 2007/0113429 | A1* | 5/2007 | Long | A43B 3/0031 36/11.5 |
| 2008/0005934 | A1* | 1/2008 | Fernandez | A43B 3/0031 36/15 |
| 2008/0047164 | A1 | 2/2008 | Vindriis | |
| 2009/0188129 | A1* | 7/2009 | Fusco | A43B 17/02 36/44 |
| 2009/0265961 | A1* | 10/2009 | Muller | A43B 3/24 36/3 A |
| 2011/0061148 | A1* | 3/2011 | Egozi | A43B 17/14 36/43 |
| 2011/0099850 | A1* | 5/2011 | Van Dyck | A43B 3/0031 36/11.5 |
| 2015/0026999 | A1 | 1/2015 | Propet | |
| 2019/0365019 | A1* | 12/2019 | Pereira Lage | A43B 13/04 |
| 2020/0054091 | A1 | 2/2020 | Schneider | |
| 2020/0107612 | A1 | 4/2020 | Schickling | |
| 2020/0375307 | A1* | 12/2020 | Hurd | A43B 13/125 |
| 2021/0079186 | A1* | 3/2021 | Baghdadi | B32B 7/12 |
| 2021/0147650 | A1* | 5/2021 | Levy | B33Y 70/00 |

* cited by examiner

CUSTOMIZABLE PRESSURE RELIEVING DEVICE

The current application claims a priority to the U.S. Provisional Patent application Ser. No. 63/058,699 filed on Jul. 30, 2020.

FIELD OF THE INVENTION

The present invention relates generally to a customizable pressure relieving component. More specifically, the present invention is a footwear component that may be used as a shoe insole insert or as a footwear itself to improve foot function and to relieve foot pain.

BACKGROUND OF THE INVENTION

Soreness and stiffness at certain pressure points and joints are common problems faced by a lot of individuals. However, the position and intensity of these pressure points and soreness change from one individual to the other. The function of a human foot is to support body weight, provide balance, redistribute stresses, and absorb shocks. Further, each individual has a unique foot pattern and a gait as well. When we wear shoes to protect foot, foot loses direct contact with the surface and thus our natural flexibility and ability to redistribute the weight which the barefoot provides is also compromised. So, wearing the shoes that misfit or does not respond to stress, can result in problems associated with foot. While standing or moving, if foot does not adapt to the position and/or redistribute the weight, the resulting unbalanced posture can damage various parts of the body. Foot also have nerve ending connecting to multiple parts of the body. Large populace suffers from various foot-related ailments such as flat foot, knee and ankle pain, plantar fasciitis, bunions, corns etc., which makes foot pain a common problem. A large variety of over the counter (OTC) insoles for foot support are manufactured to address general problems like arch support or flat foot or to sooth pain from corns and bunions. However, most OTC insoles have minimal arch support and cushions in such OTC soles wear down, harden, or shrink and get dirty over time causing more discomfort and prompting periodic replacement. The insole which does not fit properly inside the shoe will distribute body weight in such a way that foot pain may alleviate but can cause knee and calf pain. Custom orthotics prescribed by a doctor and custom-fitted are expensive and mostly reserved for more severe foot problems. Thus, there is a need for an economical, comfortable, durable pressure relieving apparatus, that is effective in redistributing weight while providing support with minimum loss of flexibility. Further, there is a need for a customizable inner sole insert to meet individual needs.

An objective of the present invention is to provide users with a pressure relieving component that may be customized to user's needs and preferences. To that end, the present invention comprises a sleeve with one or more compartments that may be individually filled and refilled with a deformable media. The deformable media further comprises a mixture of both non-rigid deformable and rigid non-deformable particles that enable the device to conform to any shape when acted upon by a pressure and deformable media rearranges back to an alternate configuration when pressure is removed. It is further an aim of the present invention to provide a footwear component for use as a shoe insole insert which may be customized by the user to relieve pain in the areas of foot where most required. In other words, the insole of the present invention is intended to provide cushion and support selectively in various parts of the foot to suit individual needs of the user. According to the present invention, the footwear component adapts to the user's foot pattern while standing or moving. Furthermore, the present invention is durable, washable and reusable. Additionally, the present invention may be used with open shoes, closed shoes or even without any shoes, according to the preferences of the user.

DETAIL DESCRIPTIONS OF THE INVENTION

All illustrations of the drawings are for the purpose of describing selected versions of the present invention and are not intended to limit the scope of the present invention.

In reference to FIG. 1 through FIG. 6, the present invention is a pressure relieving device. An objective of the present invention is to provide users with a pressure relieving component that may be customized to user's needs and preferences. To that end, the present invention comprises a sleeve with one or more compartments that may be individually filled and refilled with a deformable media. The deformable media further comprises a mixture of both non-rigid deformable and rigid non-deformable particles that enable the device to conform to any shape when acted upon by a pressure and recover back to an alternate configuration when pressure is removed. It is further an aim of the present invention to provide a footwear component for use as a shoe insole insert which may be customized by the user to relieve pain in the areas of foot where most required. In other words, the insole of the present invention is intended to provide cushion and support selectively in various parts of the foot to suit individual needs of the user. According to the present invention, the footwear component adapts to the user's foot pattern while standing or moving. Furthermore, the present invention is durable, washable and reusable. Additionally, the present invention may be used with open shoes, closed shoes or even without any shoes, according to the preferences of the user.

Figure 1:
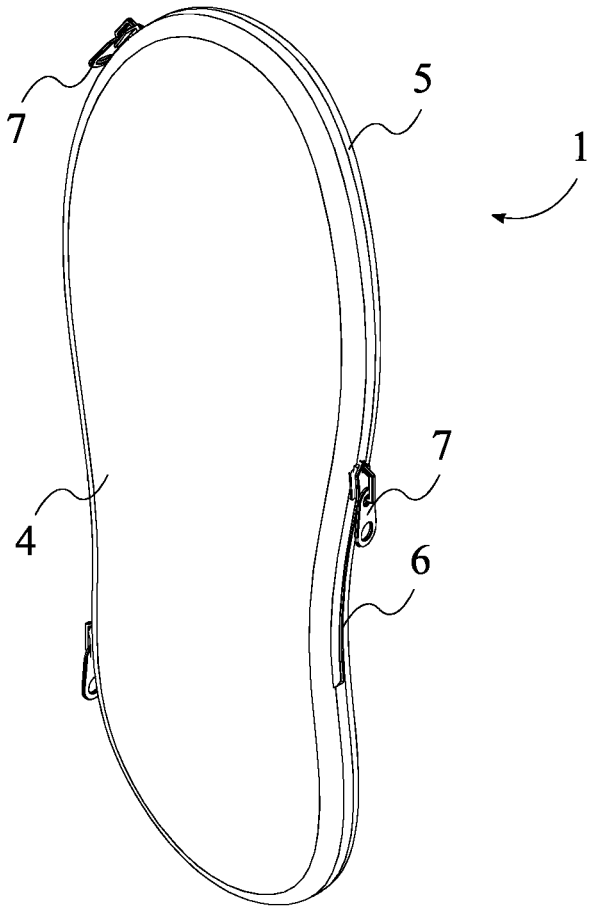
FIG. 1 is a top-front perspective view of the present invention, wherein an insole for the left foot is shown.

The following description is in reference to FIG. 1 through FIG. 6. According to a preferred embodiment, the present invention comprises a sleeve 1, a pressure responsive media 2 and at least one pocket 3. Preferably, the sleeve 1 is a sealed enclosure, and the sleeve 1 comprises a first layer 4 and a second layer 5. In the preferred embodiment, the sleeve 1 has the shape of a human feet. As seen in FIG. 1, the first layer 4 and the second layer 5 have identical shapes and the first layer 4 is perimetrically connected to the second layer 5 to form the sealed sleeve 1 with a re-closable gap in between. Preferably the first layer 4 is sewn/stitched with the second layer 5 along the perimeter. However, any other attaching means that are known to one of ordinary skill in the art may be employed to connect the first layer 4 and the second layer 5, as long as the intents of the present invention are not hindered. Examples of such attaching means include, but are not limited to stitching, zipping, using adhesives, hook and loop fasteners etc.

It is an aim of the present invention to provide users with an insole/sleeve that has customizable support and cushioning. In order to accomplish that, one or more pockets are filled with the pressure responsive media 2, wherein the pressure responsive media 2 responds to applied pressure over the sleeve 1. More specifically, the nature and pressure responsiveness of the pressure responsive media 2 indicates, responding to any kind of applied pressure. To that end, the pressure responsive media 2 is distributed within the at least one pocket 3, wherein the at least one pocket 3 is positioned within the sleeve 1. Further, the at least one pocket 3 may be partially filled with the pressure responsive media 2 or the filling be customized according to the user's preferences.

Figure 3:
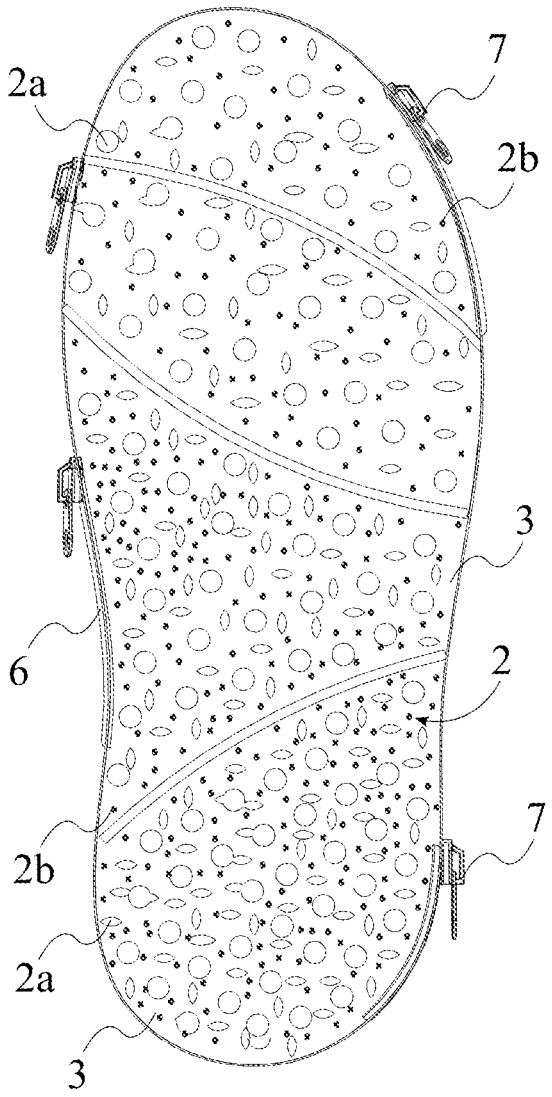
FIG. 3 is a front elevational view of an insole, wherein an upper sleeve of the present invention is shown in phantom, thereby revealing four pockets that are variably filled with deformable media.

In the preferred embodiment, the pressure responsive media 2 comprises a plurality of discrete particles of non-agglomerating deformation medium, allowing the particles to move relative to each other under pressure. In other words, the pressure responsive media 2 comprises a plurality of discrete particles of non-blocking shape, such that the discrete particles will remain free to move and will not mechanically lock under pressure or motion. As seen in FIG. 3, the discrete non-blocking particles are either deformable non-rigid particles 2*a* or non-deformable rigid particles 2*b*. It is further preferred that each of the non-deformable rigid particles 2*b* are smaller in size than each of the deformable particles 2*a*, the non-deformable particles 2*b* have lower rolling resistance than the deformable particles 2*a*, and each of the plurality of non-deformable particles 2*b* comprises a non-agglomerating shape. More specifically, a first rolling resistance of the non-deformable particles 2*b* is lower than a second rolling resistance of the deformable particles 2*a*. This is so that the non-deformable rigid particles 2*b* facilitate rolling motion, and hence may roll and move easily from a high-pressure area to a low-pressure area. Furthermore, the plurality of deformable particles 2*a* conforms to various shapes when applied with a pressure and the pressure responsive media 2 rearranges to an alternate configuration when the pressure is removed. In other words, the deformable particles 2*a* deform under pressure absorbing impact energy and the non-deformable particles 2*a* roll to a low-pressure area, thereby providing the right amount of support and cushioning under the user's foot. Thus, the pressure responsive media 2 of the present invention allows the foot of the user to adapt to position and posture, by responding to the applied pressure.

As seen in FIG. 3, the deformable particles 2*a* may comprise spheres or ellipsoids or cylinders (not shown) with maximum characteristic dimension less than 3 mm. According to the preferred embodiment, the deformable particles 2*a* may be solid or cellular particles made from elastomers, thermoplastic elastomers, thermoplastic vulcanizates or block copolymers with hardness (ASTM D 2240) ranging from 10 to 70 Shore A (ASTM D 395B), compression set at 30 C, temperature ranging from 10-30, and density of 0.2 g/cc to 1.5 g/cc. Furthermore, because of their lower surface hardness, lower compression set, resiliency and recyclability, solid elastomer particles are preferred over cellular thermoplastics like foam PS (polystyrene) or PP (polypropylene) beads. Additionally, thermoplastic elastomers free of plasticizers or with minimum plasticizers based on EPDM (ethylene propylene diene monomer), SEBS (Styrene-ethylene-butylene-styrene), or PU (polyurethane) are also preferred. However, the hardness of the deformable particles 2*a* of the pressure responsive medium 2 can be tailored to suite individual needs.

As seen in FIG. 3, the rigid particles 2*b* can be solid or hollow with substantially spherical shape with low static COF (coefficient of friction) and diameter ranging between 1 and 2 mm. Accordingly, the rigid particles 2*b* may comprise glass, plastics or naturally occurring organic seeds and have sufficient crush strength to avoid breakage under human weight. Organic seeds are preferred as they are biodegradable. Mustard seeds are preferred as they are of 1 mm size, good crush strength and have a low rolling resistance. However, the relative size of particles of the pressures sensitive media 2 may be varied to create different response to the motion. In the preferred embodiment, the pressure responsive media 2 is deformably coupled within the sleeve 1, such that the pressure responsive media 2 undergoes shape conformation under pressure, as the plurality of non-deformable particles 2*b* rolls and moves from a high-pressure area to a low-pressure area and the plurality of deformable particles 2*a* deform under pressure, absorbing impact energy. Thus, the present invention helps alleviate stress and pain for users on high pressure points, by adjusting and deforming to the user's specific needs, without sacrificing the essential support.

Figure 7:
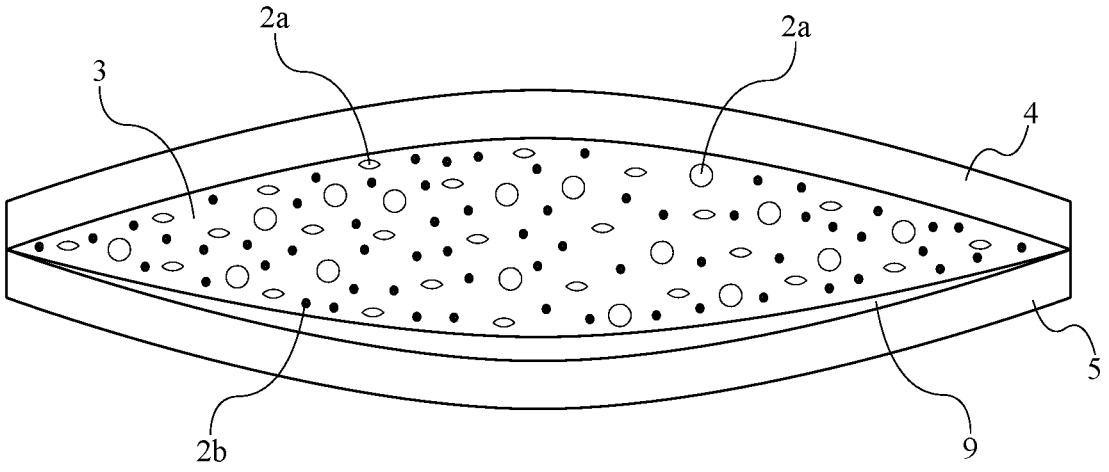
FIG. 7 is a schematic cross-sectional view taken along line 7-7 in FIG. 2.

According to the preferred embodiment, the pressure responsive medium 2 may be selectively filled into the at least one pocket 3. Preferably, the first layer 4 and the second layer 5 are connected along specific internal regions of the sleeve 1 to form the at least one non-communicating pocket 3. According to the preferred embodiment of the present invention, the first layer 4 and second layer 5 comprise wear-resistant, washable, breathable, durable, and flexible materials such as fabric, leather, soft plastic, polymer sheets, etc. However, any other material that is known to one of ordinary skill in the art may be used, as long as the objectives of the present invention are not altered. Further, it is preferred that the second layer 5 comprises semi-rigid leather or plastic. This is so that, the layer that comes in contact with the footwear or the ground is sturdy enough to withstand the friction of the footwear and/or ground. Additionally, the second layer 5 comprises attachment means to removably attach the sleeve 1 to the insole of a shoe. This attachment makes sure the sleeve 1 does not move under motion, thereby obviating the need to modify or replace the entire shoe. More specifically, the second layer 5 comprises a semi-rigid material, wherein a first static COF (coefficient of friction) of the second layer 5 is greater than a second static COF of the first layer 4. Preferably, the first layer 4 comprises a low COF material, ranging between 0.1 and 0.4, such that the low COF keeps the feet of the user cool and keeps the non-deformative particles(beads) 2*b* moving without clumping/aggregating. Furthermore, the first layer 4 (that will be in contact with the user's feet) comprises a low friction material and the second layer 5 will be a high friction and durable material to prevent it from moving inside the shoes. In alternate embodiments, the second layer 5 may be lined with an additional cushion layer 9 for additional softness and support, which is shown in FIG. 7.

Figure 2:
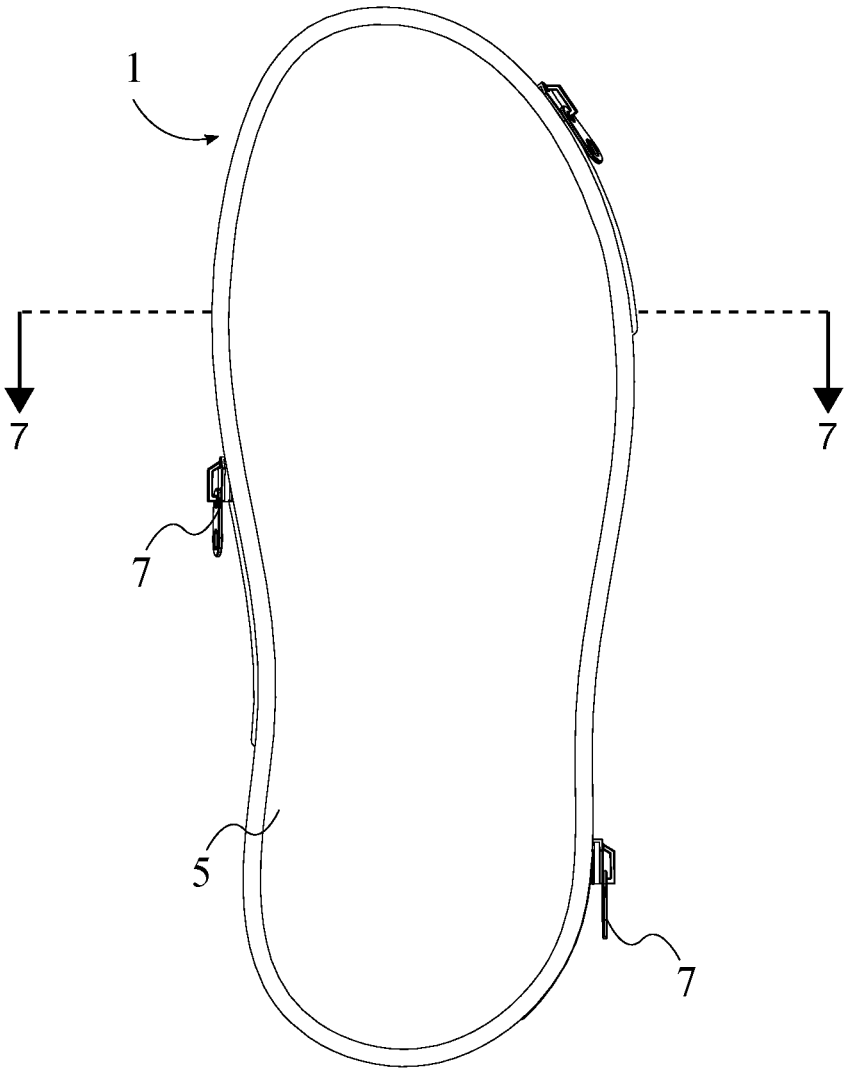
FIG. 2 is a rear elevational view of the present invention, wherein an insole for the left foot is shown.

In reference to FIG. 2, the first layer 4 and the second layer 5 of the sleeve 1 are attached such that one or more non-communicating pockets are formed within the sleeve 1 with borders of the pockets positioned along the borders of the human foot, forefoot, arch, and the rear foot. The first layer 4 may be continuously attached to the second layer 5 along the borders of the at least one pocket 3 to form sealed edges. Examples of such attaching means include, but are not limited to stitching, zipping, gluing using adhesives, molded inlock etc. Further, the present invention comprises at least one pocket opening 6, wherein the at least one pocket opening 6 traverses laterally and perimetrically into the sleeve 1 towards the at least one pocket 3. The pocket openings 6 can be of any number, shape, size, orientation etc., as long as the intents and objectives of the present invention are not altered.

Figure 4:
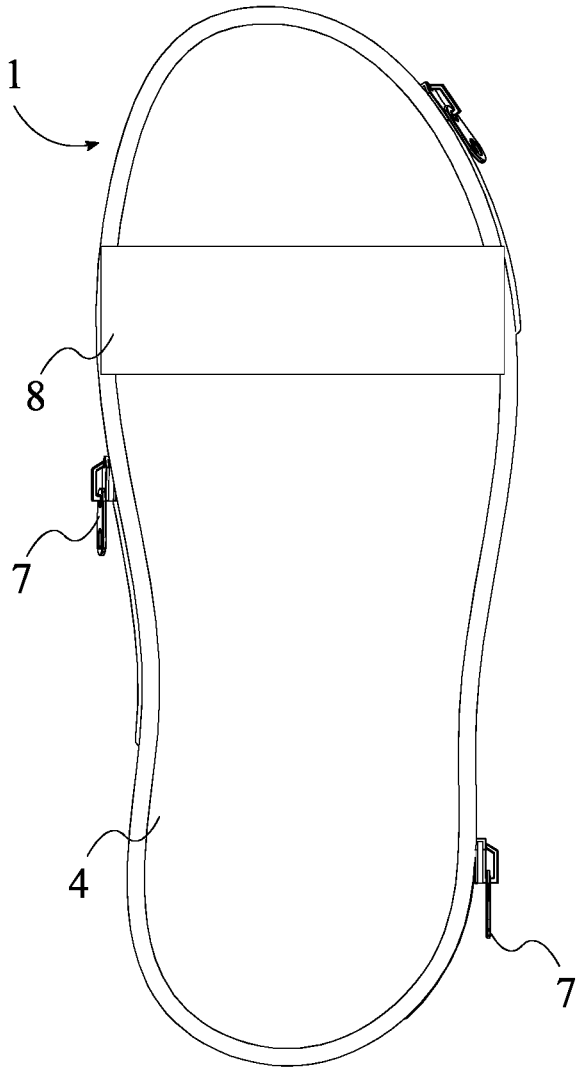
FIG. 4 is a front elevational view of the present invention, wherein a removable foot fastening strap is attached.
Figure 5:
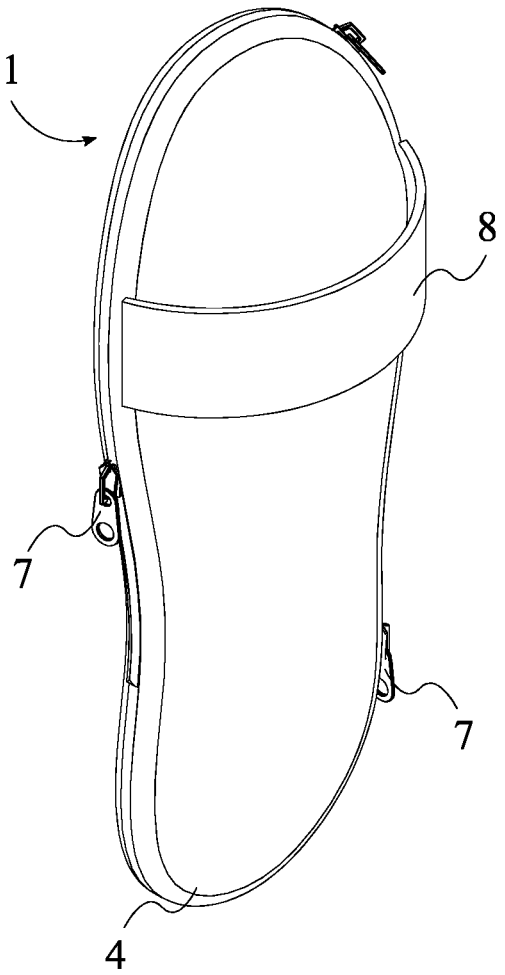
FIG. 5 is a top-front-right perspective view of the present invention, wherein a removable foot fastening strap is attached.
Figure 6:
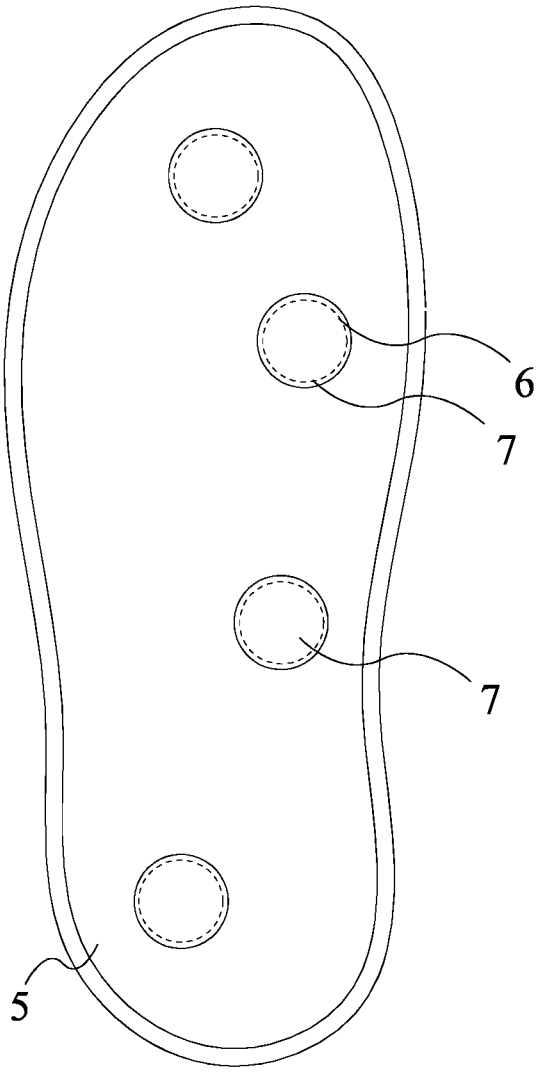
FIG. 6 is a rear elevational view of the present invention wherein re-closable snap seals are used as fasteners for closing and opening the pocket openings.

As seen in FIG. 1 through FIG. 5, the at least one pocket opening 6 are positioned along the peripheral edges of the sealed sleeve 1 and are in communication with corresponding pockets 3. In order securely fasten the at least one pocket opening 6 and contain the pressure responsive media 2 within the at least one pocket 3 without any spillage, the present invention comprises at least one pocket fastener 7. Preferably, the at least one pocket fastener 7 is integrated into the at least one pocket opening 6. In order to efficiently fill, remove, refill, and thereby adjust the pressure responsive media 2 within each pocket, the at least one pocket opening 6 is re-closable and re-openable by the at least one pocket fastener 7. In other words, each pocket of at least one pocket 3 is provided with a re-closable opening means to open and close the pockets independently. As seen in FIG. 1 through FIG. 5, zippers are used as pocket fasteners 7 for sealing the pocket openings 6 in the preferred embodiment. However, any other fasteners, that are known to one of ordinary skill in the art, and that does not hinder the intents of the present invention may be employed as pocket fasteners. Furthermore, as seen in FIG. 6, the pocket openings 6 may be positioned on the lower layer 5 of the sleeve 1, facing the ground or the footwear, and the pocket fasteners 7 may comprise snap sealers, hook & loop, or rubber stoppers. the at least one pocket opening 6 being re-closable and re-openable by the at least one pocket fastener 7.

In the preferred embodiment, the sleeve 1 is in the shape of a shoe insole. However, the sleeve 1 may comprise any other shape, size, components, and arrangement of components that are known to one of ordinary skill in the art, as long as the objectives of the present invention are fulfilled. Examples of other shapes for the sleeve 1 include, but are not limited to pillow, seat cushion, arm rest, back rest etc.

According to the preferred embodiment of the present invention, the insole may be used with open shoes, closed shoes or even without shoes. Accordingly, the present invention comprises at least one foot-fastening strap 8, wherein the at least one foot-fastening strap 8 being removably mounted onto the first layer 5 of the sleeve 1. Thus, as seen in FIG. 4 and FIG. 5, a foot fastening strap 8 is mounted onto the front surface of the sealed sleeve 1. Preferably, the foot fastening strap 8 may comprise an elastic band or a leather band. Further, the foot fastening strap 8 may be removably attached using any fasteners that are known to one of ordinary skill in the art, as long as the intents of the present invention are not altered. Examples of such fasteners include, but are not limited to, hooks, snap buckles, clips, hook and loop fasteners etc. Furthermore, a rear strap may be removably attached across the rear foot.

Continuing with the preferred embodiment of the present invention, the filling or the pressure responsive medium 2 may be filled into each of the at least one pocket 3 with the help of a filling device (such as a funnel) through the at least one pocket opening 6, to a fill level according to the preference of the user. Preferably, the fill level (the percentage of space in each pocket occupied by the deformable medium) will vary with users' weight, gait and foot pattern. For example, the rear foot area with heel absorbs most of the initial impact and weight and hence the pocket in the rear foot area preferably has higher fill level of 50-80%, followed by mid foot fill level of 30-50% and the front foot fill level of 10-30%. Further, the percentage of the rigid particles **2*b* in pressure responsive medium 2 ranges between 10-60% and preferably 10-40%. However, the insole may be customized by varying the amount of pressure responsive medium 2 in each of the at least one pocket 3, hardness of the deformable particles 2*a*, and the proportion of the deformable and rigid particles. Furthermore, the pressure responsive medium 2 may be emptied through the re-closable pocket openings 6, and the sleeve 1** may be washed for repeated use.

According to the preferred embodiment, a customer may buy a kit of the present invention, the kit comprising the sleeve 1, the filling 2, a filling device, and a pressure sensing film. The pressure sensing film may be used to determine the pressure profile of the foot of a person. Based on the pressure profile, the composition and the % filling of deformable medium in various pockets can be tailored.

Thus, a preferred method of operation of the present invention comprises the following steps:

(1) Without shoes or insole, stand on one foot at a time with both hands stretched forward, and feel or determine the area of high stress.
(2) Open the pocket fastener 7 to reveal the pocket opening 6 of at least one pocket 3, and fill with pressure responsive medium 2 particles starting with particles with higher hardness.
(3) Fill pockets under area of high stress with more deformable particles.
(4) Close the pockets 3 filled with deformable particles using the pocket fastener 7 to prevent spilling.
(5) Stand on the sleeve 1 with pockets 3 filled, one foot at a time with both hands stretched, and feel or determine the pressure in each foot.
(6) Adjust the number of deformable particles **2*a*** until pressure feels normal and comfortable.
(5) If any area feels uncomfortable, replace deformable particles with lower hardness particles.
(6) Once the right pressure distribution is achieved, add rigid particles to each pocket.
(7) Insert the insole in shoes and walk around.
(8) Notice if there is stiffness or pain in any area.
(9) Remove insoles from shoes and increase the rigid particles until proper flexibility is achieved.
(8) To wear insole without shoes or with open shoes, attach removable and adjustable straps to the sleeve, and tie to foot by adjusting the straps.
(9) To wash, reopen the re-closable openings and empty the deformable media.

In addition to the aforementioned description of the present invention, possible alternate embodiments are discussed. Note that any and all possible alternate embodiments, variations, modifications, and/or improvements are still considered within the scope of the invention. Thus, the following description discloses a plurality of alternate embodiments and/or additional components but does not limit the scope of the invention in any way shape or form.

In a first alternate embodiment of the present invention, the customer buys a kit comprising the sleeve, the filling, a filling device, and a pressure sensing film. After standing on the pressure sensing film/mat, the customer uploads an image of the pressure responsive film with the customer's foot pattern to a vendor designed app, wherein the app may provide the necessary advice to mix the filling in certain ways to balance and reduce pain points of a corresponding customer.

In a second alternate embodiment of the present invention, the customer may buy an insole with a prefilled sleeve, by reading the description of the hardness level on each pocket, as displayed on the product package.

In a third alternate embodiment, the present invention comprises a first sleeve and a second sleeve stitched across the customizable footwear component. The first sleeve and the second sleeve are stitched to the outer surface of the footwear component. The first sleeve and second sleeve are not limited to a stitched method or technique, but rather any feasible means. The first sleeve and the second sleeve form two channels across the customizable footwear component. The two channels formed by the first sleeve and the second sleeve provide a fastening mean for tying a protistic to a foot when the present invention is utilized without shoes. The two channels formed by the first sleeve and the second sleeve function as receptacles for a strap to traverse across the customizable footwear component. Thus, allowing a secure but temporary binding of the present invention when the customizable footwear is utilized without shoes.

In a fourth alternate embodiment, the present invention comprises a deep slot. The deep slot is preferably located accordingly to the human major toe and second toe. The deep slot allows for separation of the major toe and the second toe, thus allowing utilization of the present invention with sandals, or similar-style footwear. It is important to note that the preferred location for the deep slot is not limited to such location or configuration, as any variation which is suitable is also to be considered within the scope of the present invention.

In a fifth alternate embodiment, the present invention comprises deformable thermoplastic elastomer beads. The deformable thermoplastic elastomer beads imbibed with antimicrobial and anti-odor additives. The antimicrobial and anti-odor additives slowly release to surface. Furthermore, in this alternate embodiment, the pockets to the first layer and the second layer are not filled directly. Rather, the bead mixture/pressure responsive medium is first placed in a plurality bead mixture bags. The bead mixture bags from the plurality of bead mixture bags are manufactured from anti-friction material and in a geometric profile similar to the pockets from the present invention. The bead mixture bags provide means for containing the bead mixture, while preventing the bead mixture from spilling.

In a sixth alternate embodiment the present invention comprises a narrow pocket. The narrow pocket is distributed around the edge of the lower layer. Alternatively, the narrow pocket may also only distribute around a particular portion of the lower layer. The narrow pocket houses a round semi-rigid rod. The round semi-rigid rod allows the customizable footwear component to keep its geometrical profile while inserting in shoes.

In a seventh alternate embodiment, the customizable footwear component does not comprise a toe section or a heel section. Meaning, the surface area from the present invention which is in contact with the toes and the heel is removed. The partial insole provides further versatility for the variance found naturally in human anatomy, particularly feet.

In an eighth alternate embodiment, the present invention comprises an elastic heel cover and an elastic toe cover. The elastic heel cover and the elastic toe cover such that it may be pull over the foot like a sock. Therefore, the present alternate embodiment provides further application and extension of the present invention. Thus, the present invention comprises a variety of alternate embodiment which provide an illustration of the invention, but not a limitation thereof.

Although the invention has been explained in relation to its preferred embodiment, it is to be understood that many other possible modifications and variations can be made without departing from the spirit and scope of the invention as hereinafter claimed.

What is claimed is:

1. A customizable pressure relieving device comprising:

a sleeve;

a pressure responsive media;

at least one pocket;

a cushion layer;

at least one pocket opening;

at least one pocket fastener;

the sleeve comprising a first layer and a second layer;

the pressure responsive media being an exclusive heterogeneous mixture of a plurality of deformable particles and a plurality of non-deformable particles, wherein the plurality of non-deformable particles and the plurality of deformable particles are granular beads, wherein the granular beads are rollably positioned amongst each other, and wherein an interstitial material between the granular beads is exclusively air;

the sleeve being configured to be a retrofittable sole insert for a separate piece of footwear, wherein the retrofittable sole insert is readily removable from the separate piece of the footwear through a foot-receiving opening of the separate piece of footwear;

the first layer and the second layer being a pair of physically-separate planar bodies with the same size and shape;

the first layer and the second layer being positioned parallel to each other;

the first layer being stacked onto and across the second layer;

a perimeter of the first layer being coincidently connected along a perimeter of the second layer;

the second layer being lined with the cushion layer;

the at least one pocket being positioned within the sleeve;

the pressure responsive media being distributed within the at least one pocket;

the pressure responsive media being deformably coupled within the sleeve, such that the pressure responsive media undergoes shape conformation under pressure, as the plurality of non-deformable particles rolls and moves from high pressure area to low pressure area and the plurality of deformable particles deform under pressure, absorbing impact energy;

the at least one pocket opening traversing laterally and perimetrically into the sleeve towards the at least one pocket;

the at least one pocket fastener being integrated into the at least one pocket opening;

the at least one pocket being a plurality of pockets, wherein the plurality of pockets includes a first pocket, a second pocket, a third pocket, and a fourth pocket;

the first pocket being positioned at a toe-bracing section of the retrofittable sole insert;

the second pocket being positioned at a forefoot-bracing section of the retrofittable sole insert;

the second pocket being conterminously positioned adjacent to the first pocket;

the third pocket being positioned at a midfoot-bracing section of the retrofittable sole insert;

the third pocket being conterminously positioned adjacent to the second pocket, opposite to the first pocket;

the fourth pocket being positioned at a heel-bracing section of the retrofittable sole insert;

the fourth pocket being conterminously positioned adjacent to the third pocket, opposite to the second pocket;

a combined internal space of the plurality of pockets spanning through a lumen of the sleeve;

the at least one pocket opening being a plurality of pocket openings, wherein each of the plurality of pockets is associated with a corresponding opening from the plurality of pocket openings;

the at least one pocket fastener being a plurality of pocket fasteners, wherein each of the plurality of pocket openings being associated to a corresponding fastener from the plurality of pocket fasteners;

the corresponding opening of the first pocket being positioned along an outside-foot section of the retrofittable sole insert;

the corresponding opening of the second pocket being positioned along an inside-foot section of the retrofittable sole insert;

the corresponding opening of the third pocket being positioned along the inside-foot section of the retrofittable sole insert, offset from the corresponding opening of the second pocket;

the corresponding opening of the fourth pocket being positioned along the outside-foot section of the retrofittable sole insert, offset from the corresponding opening of the first pocket;

the plurality of pockets being distributed throughout the sleeve; and the pressure responsive media being positioned within at least one selected pocket from the plurality of pockets.

2. The customizable pressure relieving device of claim 1, wherein the at least one pocket opening is re-closable and re-openable by the at least one pocket fastener.

3. The customizable pressure relieving device of claim 1, wherein the sleeve is the shape of a shoe insole.

4. The customizable pressure reliving device of claim 1 comprising:

at least one foot-fastening strap; and the at least one foot-fastening strap being removably mounted onto the first layer of the sleeve.

5. The customizable pressure relieving device of claim 1, wherein each of the plurality of non-deformable particles is smaller in size than each of the plurality of deformable particles.

6. The customizable pressure relieving device of claim 1, wherein each of the plurality of non-deformable particles is a non-agglomerating shape.

7. The customizable pressure relieving device of claim 1, wherein a first rolling resistance of the non-deformable particles is lower than a second rolling resistance of the deformable particles.

8. The customizable pressure relieving device of claim 1, wherein the plurality of deformable particles conforms to various shapes when applied with a pressure, and wherein the pressure responsive media rearranges to an alternate configuration when the pressure is removed.

9. The customizable pressure relieving device of claim 1, wherein the second layer is made of a semi-rigid material.

10. The customizable pressure relieving device of claim 1, wherein the first layer and the second layer are connected along specific regions of the sleeve to form the at least one pocket.

11. The customizable pressure relieving device of claim 1, wherein the at least one pocket is partially filled with the pressure responsive media.

12. The customizable pressure relieving device of claim 1, wherein a first COF (coefficient of friction) of the second layer is greater than a second COF of the first layer.

13. A customizable pressure relieving device comprising:

a sleeve;

a pressure responsive media;

at least one pocket;

a cushion layer;

at least one pocket opening;

at least one pocket fastener;

at least one foot-fastening strap;

the sleeve comprising a first layer and a second layer;

the pressure responsive media being an exclusive heterogenous mixture of a plurality of deformable particles and a plurality of non-deformable particles, wherein the plurality of non-deformable particles and the plurality of deformable particles are granular beads, wherein the granular beads are rollably positioned amongst each other, and wherein an interstitial material between the granular beads is exclusively air;

the sleeve being configured to be a retrofittable sole insert for a separate piece of footwear, wherein the retrofittable sole insert is readily removable from the separate piece of the footwear through a foot-receiving opening of the separate piece of footwear, and wherein the retrofittable sole insert is shaped as a shoe insole;

the first layer and the second layer being a pair of physically-separate planar bodies with the same size and shape;

the first layer and the second layer being positioned parallel to each other;

the first layer being stacked onto and across the second layer;

a perimeter of the first layer being coincidently connected along a perimeter of the second layer;

the second layer being lined with the cushion layer;

the at least one pocket being positioned within the sleeve;

the plurality of non-deformable particles being heterogeneously mixed into the plurality of deformable particles;

the plurality of non-deformable particles and the plurality of deformable particles being granular beads, wherein the granular beads are rollably positioned amongst each other;

the pressure responsive media being distributed within the at least one pocket;

the pressure responsive media being deformably coupled within the sleeve, such that the pressure responsive media undergoes shape conformation under pressure, as the plurality of non-deformable particles rolls and moves from high pressure area to low pressure area and the plurality of deformable particles deform under pressure, absorbing impact energy;

the at least one pocket opening traversing laterally and perimetrically into the sleeve towards the at least one pocket;

the at least one pocket fastener being integrated into the at least one pocket opening, wherein the at least one pocket opening is re-closable and re-openable by the at least one pocket fastener;

the at least one pocket being a plurality of pockets, wherein the plurality of pockets includes a first pocket, a second pocket, a third pocket, and a fourth pocket;

the first pocket being positioned at a toe-bracing section of the retrofittable sole insert;

the second pocket being positioned at a forefoot-bracing section of the retrofittable sole insert;

the second pocket being conterminously positioned adjacent to the first pocket;

the third pocket being positioned at a midfoot-bracing section of the retrofittable sole insert;

the third pocket being conterminously positioned adjacent to the second pocket, opposite to the first pocket;

the fourth pocket being positioned at a heel-bracing section of the retrofittable sole insert;

the fourth pocket being conterminously positioned adjacent to the third pocket, opposite to the second pocket;

a combined internal space of the plurality of pockets spanning through a lumen of the sleeve;

the at least one pocket opening being a plurality of pocket openings, wherein each of the plurality of pockets is associated with a corresponding opening from the plurality of pocket openings;

the at least one pocket fastener being a plurality of pocket fasteners, wherein each of the plurality of pocket openings being associated to a corresponding fastener from the plurality of pocket fasteners;

the corresponding opening of the first pocket being positioned along an outside-foot section of the retrofittable sole insert;

the corresponding opening of the second pocket being positioned along an inside-foot section of the retrofittable sole insert;

the corresponding opening of the third pocket being positioned along the inside-foot section of the retrofittable sole insert, offset from the corresponding opening of the second pocket;

the corresponding opening of the fourth pocket being positioned along the outside-foot section of the retrofittable sole insert, offset from the corresponding opening of the first pocket;

the plurality of pockets being distributed throughout the sleeve;

the pressure responsive media being positioned within at least one selected pocket from the plurality of pockets;

the at least one foot-fastening strap being removably mounted onto the first layer of the sleeve;

the second layer being made of a semi-rigid material;

the at least one pocket being partially filled with the pressure responsive media; and a first COF of the second layer being greater than a second COF of the first layer.

14. The customizable pressure relieving device of claim 13, wherein each of the plurality of non-deformable particles is smaller in size than each of the plurality of deformable particles.

15. The customizable pressure relieving device of claim 13, wherein each of the plurality of non-deformable particles is a non-agglomerating shape.

16. The customizable pressure relieving device of claim 13, wherein a first rolling resistance of the non-deformable particles is lower than a second rolling resistance of the deformable particles.

17. The customizable pressure relieving device of claim 13, wherein the plurality of deformable particles conforms to various shapes when applied with a pressure, and wherein the pressure responsive media rearranges to an alternate configuration when the pressure is removed.

18. The customizable pressure relieving device of claim 13, wherein the first layer and the second layer are connected along specific regions of the sleeve to form the at least one pocket.

* * * * *